US007954665B2

(12) United States Patent
Abbosh et al.

(10) Patent No.: US 7,954,665 B2
(45) Date of Patent: Jun. 7, 2011

(54) WIPES BEING FORMED INTO A NON-PLANAR FORM AND DISPENSES FOR STORING SAID WIPES

(75) Inventors: Oday Abbosh, London (GB); Ian Hamilton Dryburgh, Sparsholt (GB); Nigel Lawson, Sevenoaks (GB)

(73) Assignee: Oday Abbosh, London (GB)

( * ) Notice: Subject to any disclaimer, the term of this patent is extended or adjusted under 35 U.S.C. 154(b) by 0 days.

(21) Appl. No.: 11/813,588

(22) PCT Filed: Dec. 20, 2005

(86) PCT No.: PCT/GB2005/004972

§ 371 (c)(1),
(2), (4) Date: Sep. 20, 2007

(87) PCT Pub. No.: WO2006/072764

PCT Pub. Date: Jul. 13, 2006

(65) Prior Publication Data

US 2008/0210703 A1 Sep. 4, 2008

(30) Foreign Application Priority Data

Jan. 10, 2005 (GB) ..... 0500403.1

(51) Int. Cl.
*A47K 10/18* (2006.01)
*B32B 3/04* (2006.01)

(52) U.S. Cl. ..... 221/33; 221/1; 221/47

(58) Field of Classification Search ..... 221/33; 428/7, 12, 26, 64.1, 127, 130
See application file for complete search history.

(56) References Cited

U.S. PATENT DOCUMENTS

| | | | | | |
|---|---|---|---|---|---|
| 1,015,085 | A | | 1/1912 | Salstrom | |
| 1,398,030 | A | * | 11/1921 | Luellen | 206/499 |
| 1,501,662 | A | * | 7/1924 | Horwitt | 206/494 |
| 1,503,241 | A | * | 7/1924 | Horwitt | 221/52 |
| 1,762,977 | A | * | 6/1930 | Green | 220/574.3 |
| 1,915,006 | A | * | 6/1933 | Swift | 221/63 |
| 1,936,203 | A | * | 11/1933 | Neu et al. | 15/230.1 |
| 2,171,484 | A | * | 8/1939 | Squire | 210/497.2 |
| 2,533,815 | A | * | 12/1950 | Kelly | 210/455 |
| 2,552,474 | A | * | 5/1951 | Amberg | 225/74 |
| 2,563,633 | A | * | 8/1951 | Amberg | 493/154 |
| 2,705,089 | A | * | 3/1955 | Bennett | 221/45 |
| 3,019,940 | A | * | 2/1962 | Sutton | 221/48 |
| 3,315,018 | A | * | 4/1967 | Commeyras | 264/51 |
| 3,369,700 | A | | 2/1968 | Nelson | |
| 4,143,762 | A | * | 3/1979 | Spiegelberg | 206/210 |
| 4,166,551 | A | | 9/1979 | Stiros | |
| 4,619,766 | A | * | 10/1986 | Smiley et al. | 210/482 |
| 4,874,112 | A | * | 10/1989 | Mulder et al. | 221/1 |

(Continued)

FOREIGN PATENT DOCUMENTS

GB 1 376 403 12/1974

(Continued)

*Primary Examiner* — Gene Crawford
*Assistant Examiner* — Kelvin L Randall, Jr.
(74) *Attorney, Agent, or Firm* — Alan Kamrath; Kamrath & Associates PA

(57) ABSTRACT

A wipe includes a generally flat piece of material (10) made of paper, cloth or the like. The generally flat piece of material (10) is formed into a non-planar form having a three-dimensional shape, for example conical, for storage and dispensing.

15 Claims, 1 Drawing Sheet

U.S. PATENT DOCUMENTS

| | | | | |
|---|---|---|---|---|
| 5,017,174 | A * | 5/1991 | Gowrylow | 450/37 |
| 5,833,680 | A * | 11/1998 | Hartman | 604/385.17 |
| 7,204,390 | B2 * | 4/2007 | Widlund | 221/47 |
| 7,300,425 | B1 * | 11/2007 | Mants et al. | 604/385.01 |
| 2002/0068144 | A1 | 6/2002 | McCumber | |
| 2004/0222582 | A1 * | 11/2004 | Widlund | 270/32 |

FOREIGN PATENT DOCUMENTS

| | | | |
|---|---|---|---|
| GB | 2 361 907 | A | 7/2001 |
| JP | 8256942 | A | 10/1996 |
| JP | 11076097 | | 3/1999 |
| WO | 2004/093627 | | 11/2004 |

* cited by examiner

WIPES BEING FORMED INTO A NON-PLANAR FORM AND DISPENSES FOR STORING SAID WIPES

This invention relates to wipes. The term "wipes" is used herein to refer to the kinds of disposable absorbent products known variously as tissues, cloths, paper towels, kitchen roll and the like, which may be made of paper, cloth or any other suitable material and which may be moist, wet or dry and which may be embossed, perforated, quilted or printed or have any other surface decoration or treatment.

Conventional products of this nature, and the dispensers in which they can be stored, are typically not very attractive to look at. Also it is often necessary to use two hands to extract the product from its dispenser. The present invention seeks to improve upon these existing products.

The invention provides a wipe comprising a generally flat piece of material in which said piece of material is formed into a non-planar form having a three-dimensional shape for storage in said shape.

The invention also provides a dispenser for storing a multiplicity of wipes, wherein the dispenser has a body which is adapted to suit the three-dimensional shape of the wipes.

The invention further provides a method of making wipes comprising the steps of producing a generally flat piece of material, forming the piece of material into a non-planar form having a three-dimensional shape and storing the piece of material in said shape.

Figure 1A:
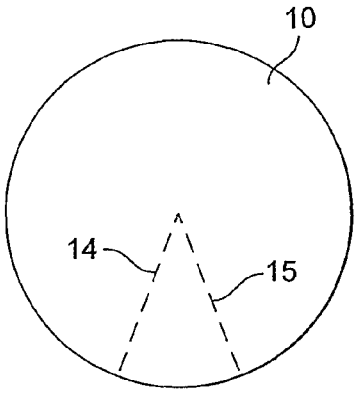
Figure 1B:
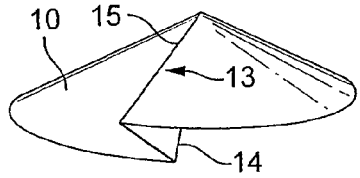
Figure 1C:
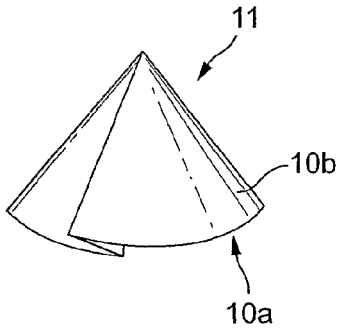
Figure 2:
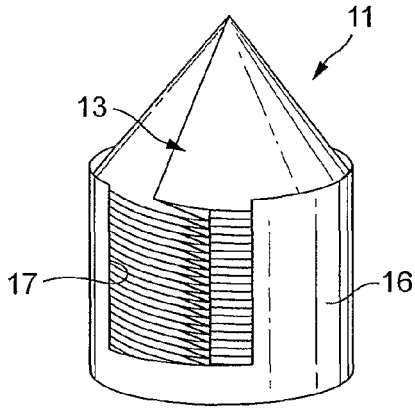
Figure 3:
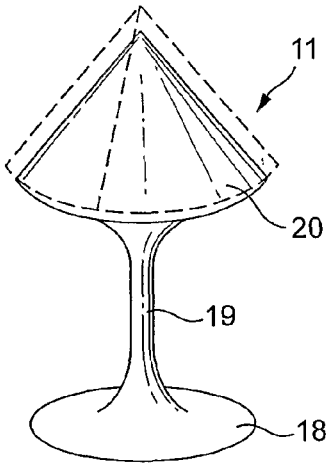
Figure 4:
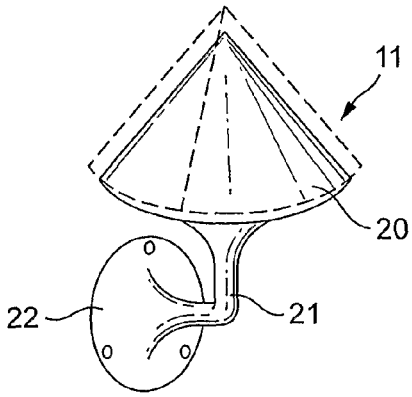

By way of example, embodiments of the invention will now be described with reference to the accompanying drawings, in which:

FIGS. 1*a*, 1*b* and 1*c* show a wipe according to the invention in its various stages of formation, and FIGS. 2, 3 and 4 show various forms of dispensers suitable for storing the wipes of FIG. 1*c*.

The wipe shown in the drawings is formed initially as a flat round disc 10 of material (FIG. 1*a*). The wipe may comprise a single layer of material, or it may have two or more plies of the same or different materials. Here, the wipe has a laminated construction, with a lower layer 10*a* of absorbent material, such as paper or the like, and an upper layer 10*b* of impervious material, such as glacene paper. Each of the layers 10*a*, 10*b* may comprise one or more plies. The wipe may be impregnated, for example with a scent and/or possibly with an antibacteriological agent. The disc 10 may be formed by any suitable process, such as by being cut from a web of material produced in a continuous process on a machine.

As seen in FIGS. 1*a*, 1*b* and 1*c*, the wipe is transformed from the planar form of disc 10 seen in FIG. 1*a* into the three-dimensional form 11 seen in FIG. 1*c* by tucking in a pleat 13 formed by two radial fold lines 14, 15 in the disc 10. The pleat 13 enables the disc 10 to be partially wrapped over itself, as seen in FIG. 1*b*, which has the effect of drawing it into a conical configuration, as seen in FIG. 1*c*.

By the nature of the material of which it is made, the wipe will tend to remain in its conical configuration once formed, and a number of wipes can thus be stacked one upon another in this configuration. There will be a tendency for the pleat 13 to protrude slightly from the wipe's conical profile, and this provides a useful provision by which a user can readily grasp a wipe from a stack. It will be noted that this can be done using only one hand. When a wipe is to be used to mop up a spillage of liquid on a kitchen top, for example, it can be lifted from a stack by its pleat 13, carried to the spill and simply dropped onto it. When dropped, the wipe will tend to unwrap and return to its original planar form. This transformation will be assisted as the lower layer 10*a* begins to absorb the liquid from the spill. When all the spilt liquid has been absorbed (or when the wipe has become saturated), the wipe can be lifted and disposed of. In this process, the upper layer 10*b* ensures that the user's hand does not become wet or soiled.

Various dispensers suitable for storing the wipes of FIG. 1*c* are seen in FIGS. 2, 3 and 4. The dispenser of FIG. 2 comprises an essentially round hollow cylindrical body 16 with an internal diameter roughly equal to the overall diameter of the wipes when in their conical form of FIG. 1*c*. A vertical slit 17 in the container body allows access to the pleat 13 of the uppermost wipe in the stack for grasping by a user.

The dispenser of FIG. 3 is in the nature of a free-standing support, with a base 18, a stem 19 and a head 20. The head 20 has a conical configuration to suit the conical configuration of the wipes, which sit upon it.

The dispenser of FIG. 4 is similar to that of FIG. 3 in that it has a conically-shaped head 20 on which the wipes are stacked. Here, however, the head 20 is attached by an elbow 21 to a bracket 22 which enables the dispenser to be mounted on a wall.

A stack of wipes stored and presented in the manner described above offers a more attractive solution for a kitchen than the more traditional forms of paper roller. The arrangement also facilitates use of the wipes, because they can be picked up with just one hand, unlike removing a tissue from a conventional roll of kitchen paper, which often requires two hands. Furthermore, the material and form of the wipe maximise its efficiency and ease of use.

It will be understood that the wipe may be formed initially in any suitable shape, not necessarily a geometric shape, and that it may also be formed into any suitable three-dimensional shape, again not necessarily a geometric one.

The invention claimed is:

1. A method of using a wipe comprising:

producing a piece of material formed of at least one ply of absorbent material and having a generally flat shape; forming the piece of material into a non-planar form having a three-dimensional, geometric, conical shape including a point and a circular base and defining a hollow interior; storing the piece of material in said non-planar form; grasping the stored piece of material in the non-planar form and placing the stored piece of material on a spill in the non-planar form; and returning the piece of material in the non-planar form placed on the spill to the generally flat shape after being placed on the spill, wherein producing the piece of material comprises producing the piece of material of a laminated construction having a lower layer including the at least one ply of absorbent material and an upper layer of impervious material, with forming the piece of material comprises forming the piece of material with the lower layer intermediate the hollow interior and the upper layer.

2. A method as claimed in claim 1 wherein forming the piece of material comprises folding two folds in the piece of material each extending radially from the point, wherein the two folds define a pleat externally of the non-planar form allowing the piece of material to be partially wrapped over itself, with grasping the stored piece of material comprising grasping the pleat.

3. A method as claimed in claim 1 wherein producing the piece of material comprises producing the piece of material having a generally circular, geometric shape.

4. The method of claim 1 wherein producing the piece of material comprises producing the piece of material from impregnated material.

5. A wipe comprising: a piece of material formed of at least one ply of absorbent material and having a generally flat shape, wherein the piece of material is formed of upper and lower layers, with the upper layer being of impervious material, with the lower layer including the at least one ply of absorbent material; first and second folds in the piece of material to form said piece of material into a non-planar form having a three-dimensional, geometric and conical shape for storage in said non-planar form, with the conical shape including a point and a circular base defining a hollow interior, with the first and second folds each extending from the point to first and second locations on the circular base; and a pleat defined by the first and second folds in the piece of material, wherein the pleat protrudes externally slightly from the non-planar form and away from the hollow interior to provide a means for grasping the non-planar form by a user, with the upper layer located intermediate the pleat and the lower layer.

6. A wipe as claimed in claim 5 wherein the piece of material has a geometric shape.

7. A wipe as claimed in claim 6 wherein the geometric shape is generally circular, with the first and second folds extending radially relative to the circular geometric shape.

8. A wipe as claimed in claim 5 wherein the piece of material comprises two or more plies.

9. A wipe as claimed in claim 8 wherein the piece of material is made of two or more different materials.

10. A wipe as claimed in claim 9 wherein the piece of material is impregnated.

11. A wipe as claimed in claim 10, further comprising: a dispenser having a body which is adapted to suit the non-planar form.

12. A wipe as claimed in claim 11 wherein the wipes are stored in or on the dispenser one upon another in a nested stack with the pleat located externally in the nested stack.

13. A wipe as claimed in claim 5 wherein the piece of material is impregnated.

14. A wipe as claimed in claim 5 wherein the piece of material is made of two or more different materials.

15. A wipe as claimed in claim 5 wherein the piece of material comprises two or more plies.

* * * * *